United States Patent [19]

Hochmuth

[11] 4,074,708

[45] Feb. 21, 1978

[54] BURNING HYDROGEN AND OXYGEN TO SUPERHEAT STEAM

[75] Inventor: Frank William Hochmuth, Hudson, Canada

[73] Assignee: Combustion Engineering, Inc., Windsor, Conn.

[21] Appl. No.: 693,252

[22] Filed: June 7, 1976

[51] Int. Cl.[2] ..... F24H 1/20

[52] U.S. Cl. ..... 126/360 A; 60/39.55

[58] Field of Search ..... 126/360 R, 360 A; 60/39.46 G, 39.65, 39.46, 39.55, 39.27; 431/12, 95, 75; 236/15 BB, 15 BR

[56] References Cited

U.S. PATENT DOCUMENTS

| | | | |
|---|---|---|---|
| 1,483,917 | 2/1924 | Tucker | 60/39.46 G |
| 2,224,544 | 12/1940 | Keller | 236/15 BD |
| 2,443,556 | 6/1948 | Fairbanks | 60/39.65 |
| 2,525,206 | 10/1950 | Clarke | 60/39.65 |
| 2,526,222 | 10/1950 | Goddard | 60/39.55 |
| 2,636,345 | 4/1953 | Zoller | 60/39.55 |
| 3,101,592 | 8/1963 | Robertson et al. | 60/39.46 G |
| 3,369,749 | 2/1968 | Siegmund et al. | 431/12 |
| 3,485,043 | 12/1969 | Ehrich | 431/351 |

*Primary Examiner*—John J. Camby
*Assistant Examiner*—Larry I. Schwartz
*Attorney, Agent, or Firm*—Robert L. Olson

[57] ABSTRACT

Apparatus for rapidly superheating steam flowing to a turbine, so that the unit can be quickly put back in operation after a short shutdown; i.e., a hot restart. The apparatus includes a unique burner for burning hydrogen and oxygen directly in the steam lines to the turbine.

3 Claims, 2 Drawing Figures

BURNING HYDROGEN AND OXYGEN TO SUPERHEAT STEAM

BACKGROUND OF THE INVENTION

In the operation of high pressure, high temperature modern steam generating stations, a problem exists when the turbine is rapidly shutdown for short periods of time and then restarted. During normal operation the temperature of the parts of the turbine are in equilibrium with the steam supplied to and flowing through it. When the turbine is rapidly stopped, the turbine parts tend to maintain their temperature, and when the boiler is restarted, the steam initially supplied to the turbine is at a much lower temperature. Therefore, it is desirable to have a means to adjust the temperature of the steam supply to quickly match the temperature of the turbine.

SUMMARY OF THE INVENTION

The apparatus of the invention includes a burner and an ignition system for burning hydrogen and oxygen directly in a steam line. The steam flowing through and around the burner is used to cool the burner housing, preventing heat damage to the burner apparatus. The hydrogen and oxygen are introduced into the burner and an ignition system in a manner to get intimate mixing of the two, and thus stable burning.

DESCRIPTION OF THE PREFERRED EMBODIMENT

Figure 1:
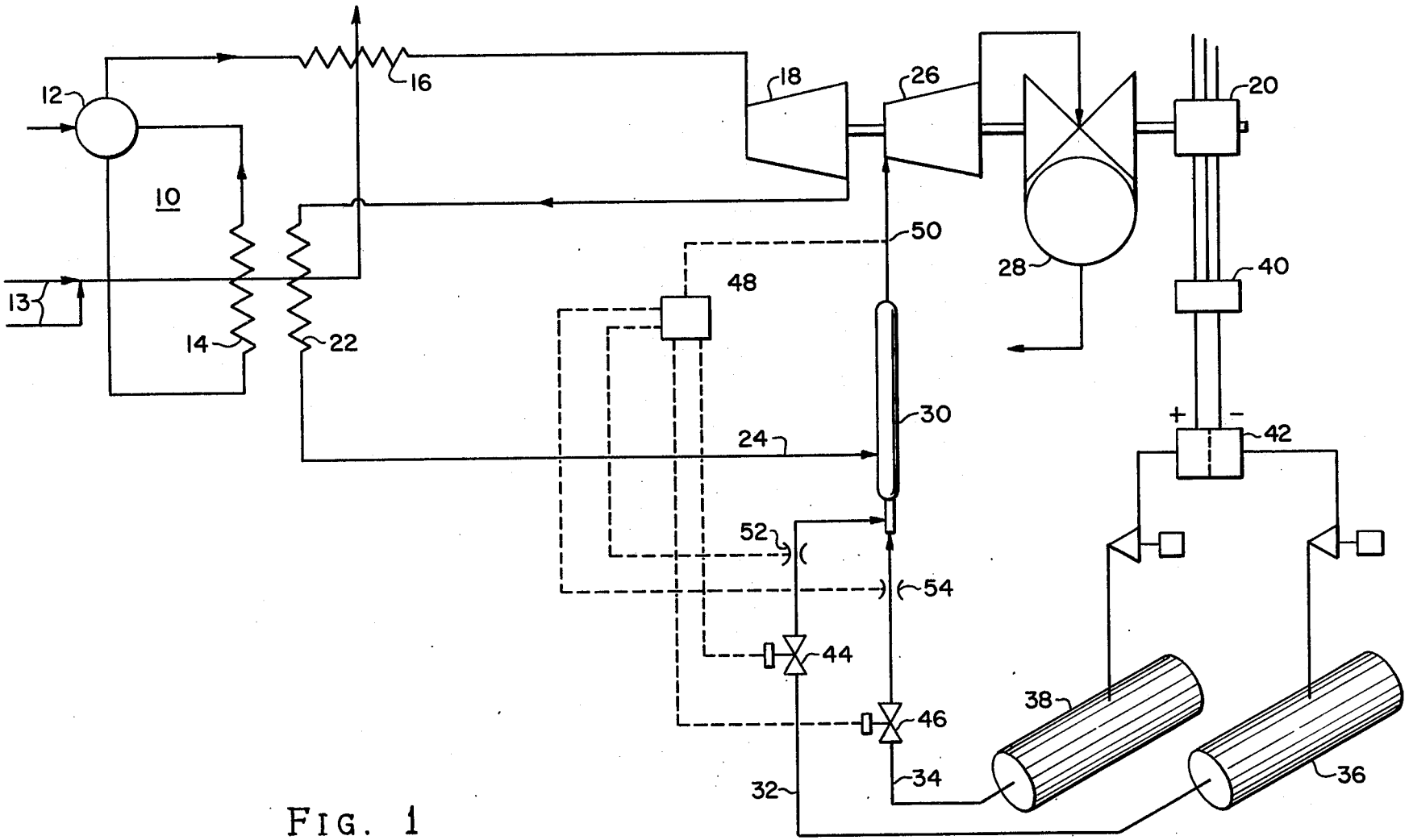
FIG. 1 is a schematic representation of a power plant including a direct fired burner for burning hydrogen and oxygen in the steam line leading to a reheat turbine.

Referring now to FIG. 1, 10 denotes a steam generator including an upper water drum 12. Water flows through downcomers from the drum 12 to feed steam generating tubes 14 which line the furnace walls. Air and fuel are introduced from sources 13 to the furnace and burned therein. The steam and water mixture leaving tubes 14 flows back to the drum 12, where the steam separates and flows through superheater tubes 16. The superheated steam then proceeds to the high pressure turbine 18. The turbine drives an electric generator 20 for generating electricity. The relatively lower temperature steam leaving turbine 18 is conducted back to the boiler, and flows through reheater 22, and from there passes through line 24 to the reheat turbine 26. The low temperature, low pressure steam exhausted from turbine 26 flows to the condensor 28, where it is condensed and thereafter returned to the drum 12 of the steam generator.

Figure 2:
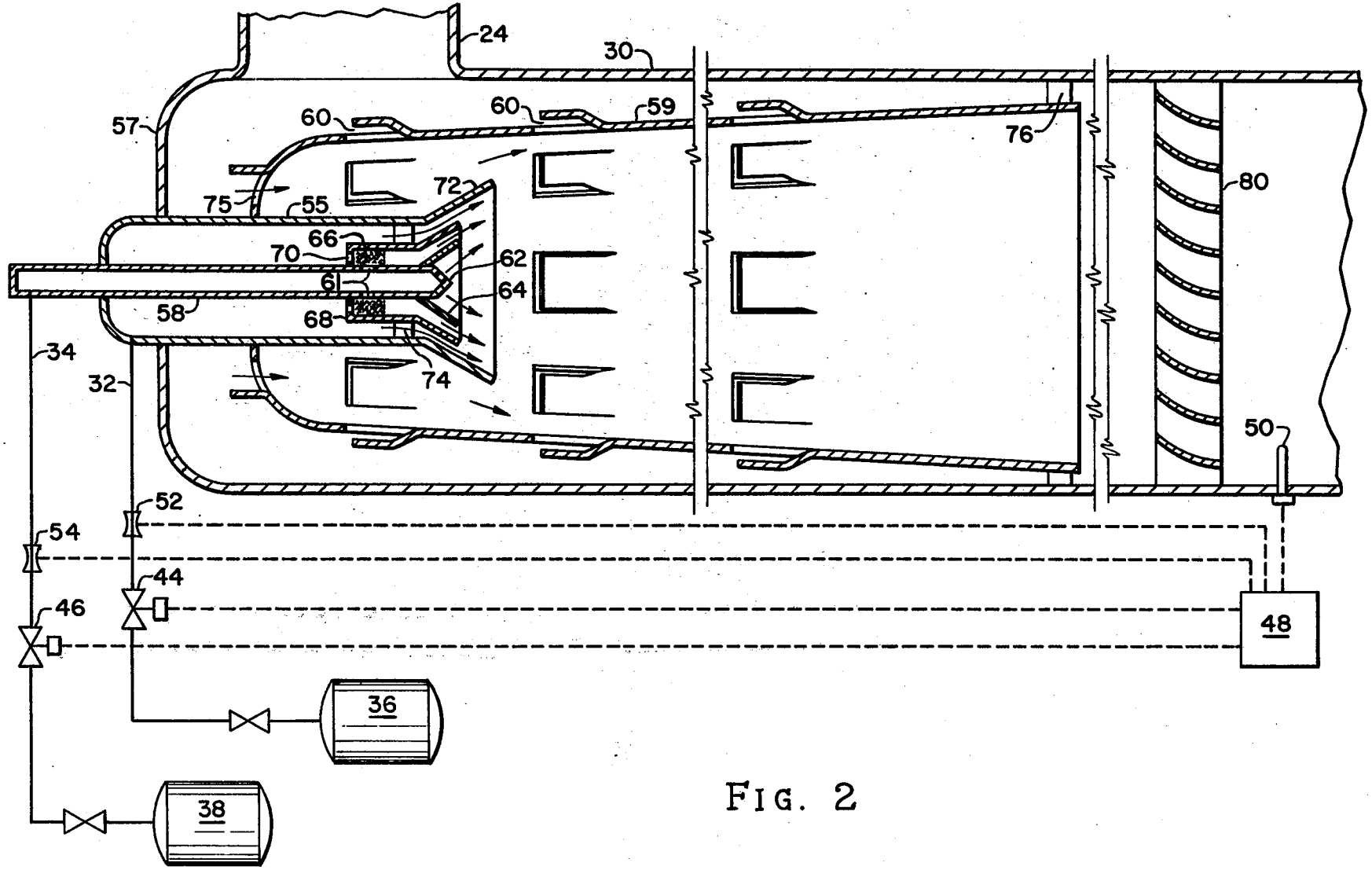
FIG. 2 is a sectional side view of the direct fired burner.

Located in the steam line 24 leading to the reheat turbine 26 is a superheater 30, in which hydrogen and oxygen are burned. The details of the superheater construction are shown in FIG. 2, and will be described later. The direct fired superheater 30 is placed in operation whenever a hot restart is made. Some steam generating units are cycled on a regular short term basis. For example, the load is reduced nightly and the unit may be shutdown on week-ends. If the turbine chest does not completely cool before the unit is put back on the line, it is necessary to match the temperature of the steam flowing to the turbine 26 with the turbine chest metal temperature in order to avoid thermal stress problems. Since it normally takes some period of time to get the boiler up to temperature, a by-pass line around turbine 26 is sometimes employed. By the use of superheater 30, in accordance with the invention, the steam from reheater 22 can be quickly raised to a temperature corresponding to the turbine metal temperature, thereby minimizing the above problem. For example, steam coming from reheater 22 may be at 550° F during a hot restart, while the turbine chest is at 900° F. By firing hydrogen and oxygen directly into the steam line in superheater 30, the steam temperature can be raised to a temperature where no thermal problems are created in the turbine. The superheater 30 is kept in operation until the steam coming from reheater 22 is at the proper temperature. This may be for a period of 20 to 30 minutes after which time fuel to the superheater 30 can be shut off.

During operation, hydrogen and oxygen are supplied to superheater 30 which includes a burner, through supply lines 32 and 34 from storage tanks 36 and 38, respectively. During normal operation of the electric generator 20, a small amount of power can be rectified in rectifier 40 to operate electrolyzer 42, generating the hydrogen and oxygen necessary for firing superheater 30 during a hot restart. Control valves 44 and 46 in lines 32 and 34 feed the proper amount of hydrogen and oxygen to the burner in superheater 30 in order to maintain the temperature leaving superheater 30 at the desired value. The valves are controlled by a controller 48 which receives a temperature signal from temperature sensing device 50. Flow meters 52 and 54 are used to measure the amount of hydrogen and oxygen flowing to the burners in superheater 30, and these signals are fed to the controller 48 to position the valves so as to maintain a stoichiometric ratio. The hydrogen and oxygen are burned directly in the steam flowing through superheater 30, thus increasing the temperature of such steam.

Looking now to FIG. 2, the details of the direct fired superheater 30 are shown. Saturated or low temperature superheated steam enters housing 57 through line 24. Oxygen is introduced through central pipe 58, and is discharged from the nozzle or spud 62. Hydrogen is delivered through concentric pipe 55 and is discharged from the horn 72. The combustion takes place within the burner combustor sleeve 59. The sleeve 59 has a series of circumferential rows of louver-like openings 60 so steam can flow along both sides thereof in order to cool it and keep it from overheating by the hot combustion taking place within the sleeve. A catalytic ignitor material 66, such as platinum gauze, is contained within housing 68. Small amounts of oxygen and hydrogen pass through the catalytic ignitor by way of openings 61 and 70, respectively, to establish the initial ignitor flame. Instead of the platinum gauze, a high energy spark ignitor could also be used. A diffuser 64 surrounding the spud 62 causes intermixing of the hydrogen, oxygen and ignitor flame, to insure a stable flame within the burner. The hydrogen is given a rotational spin by skewed radial vanes 74 just prior to the outlet end of the horn 72, to aid in the intermixing with the oxygen. One end of the combustor sleeve 59 is anchored to the hydrogen supply pipe 55, and is centrally guided at the opposite end by guide means in the form of spacer lugs 76, which are secured to the sleeve 59. These lugs allow for free expansion of the combustor sleeve 59 due to the fact that it is subjected to the combustion temperature which is higher than the temperature that housing 57 is subjected to. Steam inlet ports 75 in sleeve 59 are for the purpose of allowing some of the low temperature steam to initially mix with the combustion products, thereby reducing the temperature within the combustor sleeve 59. A diffuser in the form of a ring 80 having skewed radial vanes is located just prior to sensor 50 to cause turbulence and intermixing to get even temperature of the steam leaving housing 30.

What is claimed is:

1. Apparatus for burning hydrogen and oxygen directly within a steam line, including a steam pipe through which steam is flowing, a burner housing positioned centrally within the pipe, there being an annular space between the pipe and the burner housing through which the steam flows, pipes within the housing through which oxygen and hydrogen are introduced, ignition means for igniting the hydrogen and oxygen, the burner housing containing a plurality of openings so that the cooling steam can flow along both sides thereof, some of the openings being located upstream of the ignition means, temperature sensing means positioned downstream of the burner housing for determining the proportionate amount of hydrogen to oxygen being supplied to the burner housing, means responsive to said temperature sensing means for controlling the proportionate amount of hydrogen to oxygen flowing to the burner housing, and diffuser means upstream of the temperature sensing means to cause turbulence and intermixing of the steam leaving the burner housing.

2. The apparatus set forth in claim 1 wherein the burner housing is secured to the hydrogen pipe at one end, and is centrally guided within the steam pipe by a guide means so as to be free to thermally expand relative to the pipe.

3. The apparatus set forth in claim 2 wherein the openings in the burner housing are in a series of circumferential rows of louverlike openings, and the oxygen and hydrogen pipes are concentric pipes.

* * * * *